US006202799B1

(12) United States Patent
Drop

(10) Patent No.: US 6,202,799 B1
(45) Date of Patent: Mar. 20, 2001

(54) PROCESSING AND REGISTERING AUTOMATIC ELEVATOR CELL DESTINATIONS

(75) Inventor: Daniel R. Drop, Durham, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/347,826

(22) Filed: Jul. 2, 1999

(51) Int. Cl.[7] ..... B66B 1/16
(52) U.S. Cl. ..... 187/388; 187/391; 187/384
(58) Field of Search ..... 187/380, 381, 187/388, 384, 387, 391, 393

(56) References Cited

U.S. PATENT DOCUMENTS

| | | | | |
|---|---|---|---|---|
| 4,673,911 | * | 6/1987 | Yoshida | 187/100 |
| 4,685,538 | * | 8/1987 | Kamaike | 187/121 |
| 4,979,594 | * | 12/1990 | Begle et al. | 187/121 |
| 5,689,094 | * | 11/1997 | Friedli et al. | 187/384 |
| 5,932,853 | * | 8/1999 | Friedli et al. | 187/392 |
| 5,952,626 | * | 9/1999 | Zaharia | 187/391 |
| 5,984,051 | * | 11/1999 | Morgan et al. | 187/392 |
| 6,109,396 | * | 8/2000 | Sirag et al. | 187/381 |

FOREIGN PATENT DOCUMENTS 0 879 782 A1 5/1998 (EP) .

* cited by examiner

*Primary Examiner*—Jonathan Salata

(57) ABSTRACT

The next destination for an automatically registered elevator call is displayed to a passenger on a portable card that he carries, when he passes a beacon adjacent to the elevator, only if the destination is designated as "fixed"; if the destination is designated as "unfixed", a new next destination is determined from a record of the passenger's destinations (which may include a history of the passenger's travel habits) and the floor upon which the beacon is situated. A transponder remote from the elevator entrance responds to a transmission from the card to register a hall call for that floor; a transponder in the car can sense a transmission from the card to enter a car call for the destination floor; if there is no car transponder, the destination is stored and a car call entered automatically upon the arrival of a car in response to the hall call. If the passenger enters a new destination, it is designated as "fixed". Whenever a car call is entered for the passenger, the destination is redesignated as "unfixed". Destinations may be determined and designated centrally for all passengers, or in a distributed fashion by each corresponding card.

26 Claims, 4 Drawing Sheets

PROCESSING AND REGISTERING AUTOMATIC ELEVATOR CELL DESTINATIONS

TECHNICAL FIELD

This invention relates to automatically entering elevator calls to predetermined destinations which are altered after each trip, which are displayed in a timely fashion to the bearer, and which may be altered by the bearer.

BACKGROUND ART

The automatic entry of elevator calls, remotely, from devices carried by potential passengers has recently received much attention. Such automatic call placement systems typically match the floor upon which a passenger approaches an elevator with the usual destination of said passenger when entering the elevator at said floor. In U.S. Pat. No. 5,689,094, the passenger is not informed of his destination floor until he is at the elevator, and the only way to change it, if he desires to do so, is by means of building-mounted destination entry keys. No provision is made for identifying the particular passenger to which the newly entered destination relates. In U.S. Pat. No. 4,558,298, only the last call destination entered by voice of a passenger into microphones disposed on the building can be changed by a new destination by voice, if voice prints of the two destinations match. While this solves the problem of matching the present destination to the previous destination which it is to replace. There is no provision for automatic destination entry, Japanese published application 5-278962(A) discloses portable devices, each of which are essentially a portable car operating panel with all of the same buttons and indicators that a normal car operating panel has, thereby avoiding the necessity for each passenger to reach the car operating panel. The device therein has a cancel button to allow it to cancel a car call that it has just made. However, this does not result in changing predetermined destinations for automatic call placement. In Canadian patent publication 2,238,210, a call entered into a portable device can be changed only before it is interrogated by the building, and not after the call has been registered. In commonly owned U.S. patent application Ser. No. 09/111,077, filed Jul. 7, 1998, now U.S. Pat. No. 5,952,626 a portable, remote call entering device transmits its identification number with every call request and with every call cancellation request; however, this does not provide for altering the automatic destination floor nor informing the passenger thereof.

DISCLOSURE OF INVENTION

Objects of the invention include provision of automatic shifting from one automatic destination for a passenger, to another automatic destination for the passenger, as the passenger makes successive trips; informing the passenger of the destination that will be automatically entered; allowing the passenger to designate the destination in an overriding fashion; and controlling automatic destinations either in a centralized fashion, or in a distributed fashion.

According to the present invention, communication between a first transponder and a card borne by each passenger will cause the card to display the current next destination that will automatically be registered for the passenger bearing the card, unless said destination is designated as "unfixed", in which case a new next destination will be determined from the passenger's destination record and the floor of the beacon; communication between the card and a second transponder will cause a hall call to be entered for the passenger. Destinations entered by the passenger are designated as "fixed", and destinations are designated as "unfixed" after they have been used to enter a car call for the passenger. The determination of destinations and designating them as "fixed" or "unfixed" may either be done centrally by signal processing means in the building, or may be done in a distributed fashion by signal processing means contained within each card carried by the passengers, or part centrally and part distributed.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
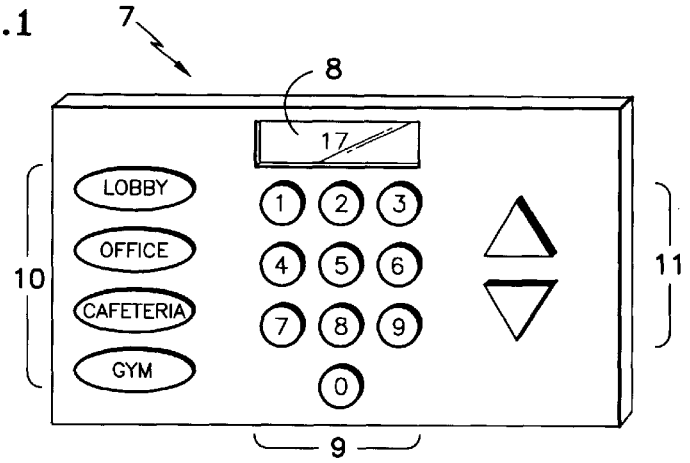
FIG. 1 is a front perspective view of an elevator card to be carried by elevator passengers, in accordance with the invention.

Referring to FIG. 1, in a system of the present invention, each passenger will carry an elevator card 7 having a display 8 and at least one of the means 9–11 to enter floor numbers. For instance, the keys 9 allow entering an actual floor number; the keys 10 allow entering a floor by its characteristics, such as lobby, office, cafeteria, or gym; and the keys 11 allow increasing or decreasing the floor number from that which is displayed on the display 8. The invention may be practiced with any one of the sets of keys 9–11, or two of them, or all three, as desired.

Figure 2:
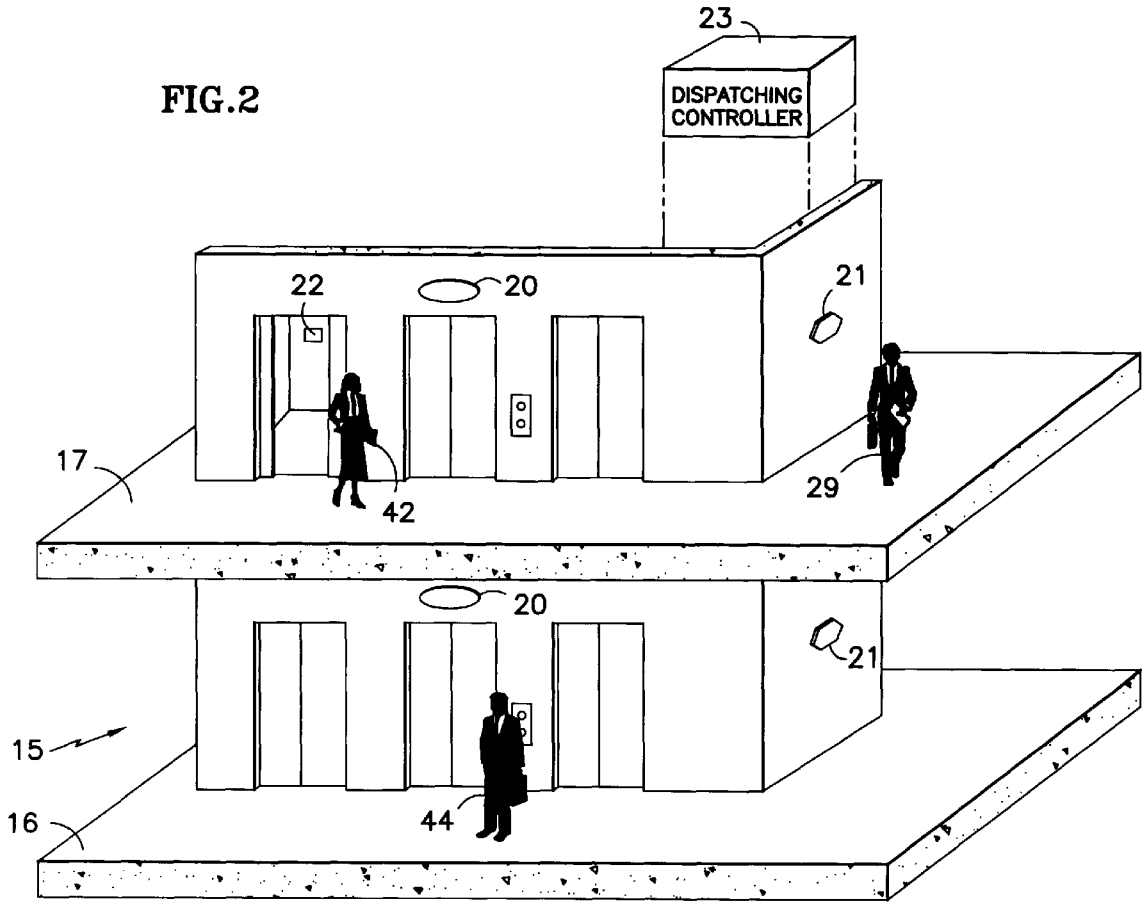
FIG. 2 is a front perspective view of two floors of a building employing the present invention.

In FIG. 2, a building 15 has a plurality of floors, only two floors 16, 17 being shown. On each floor, adjacent the elevators, there is a beacon transmitter 20, called a "beacon". Each transmission of each beacon includes a message portion identifying the current, next destination with the card ID. Remotely of the elevators, there is a hallway transponder 21. Within each elevator there is a car transponder 22. Each message from each hallway transponder includes the floor number of that transponder. The transponders 21, 22 and beacon 20 are interconnected with a dispatching controller 23.

Figure 3:
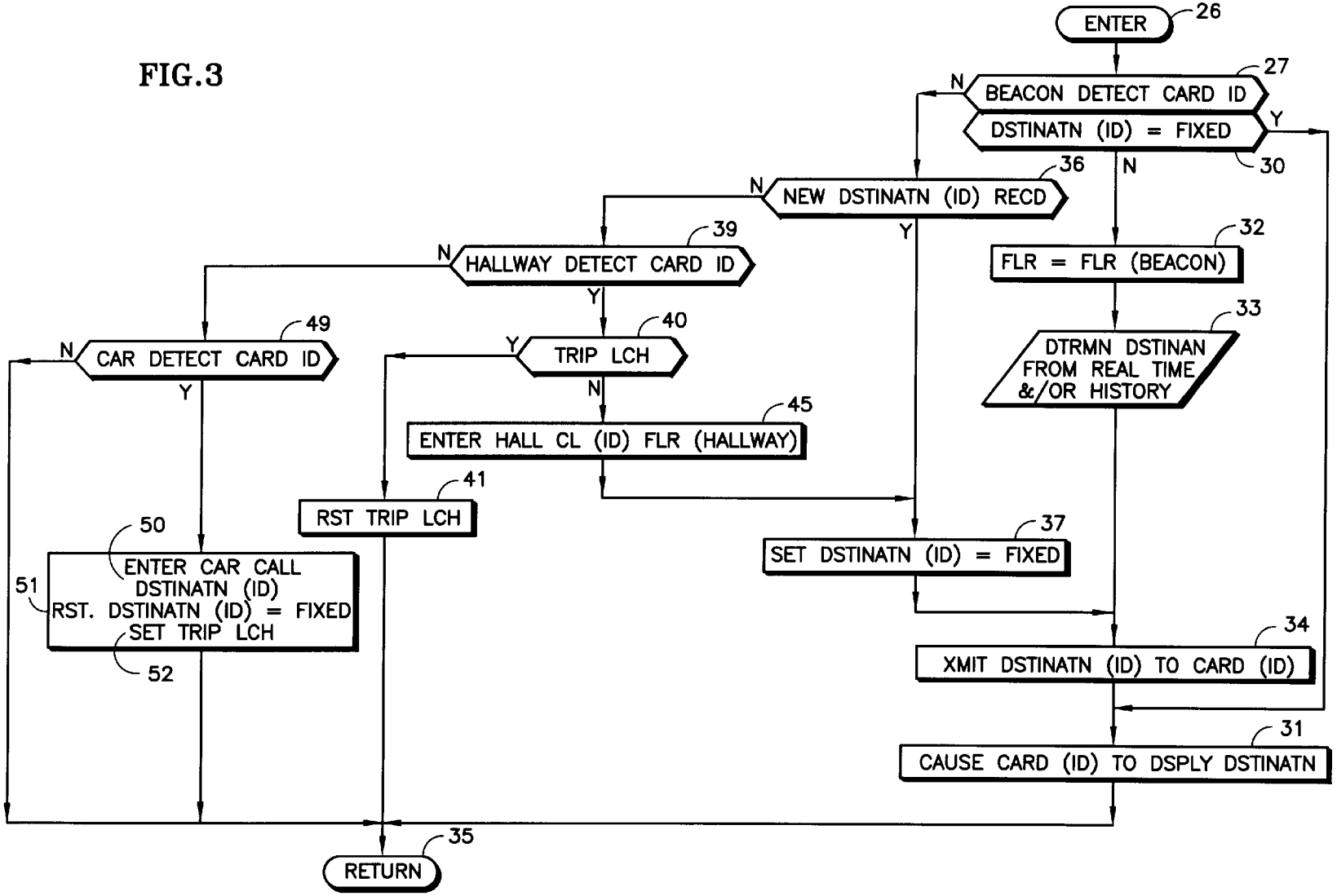
FIG. 3 is a high level functional flow chart, illustrating principles of a centralized embodiment of the invention.

In FIG. 3, upon entering a program for processing preferred destination information for the various cards 7, through an entry point 26, a first test 27 determines if a beacon has detected a card identification number, which will happen when a passenger, such as the passenger 29 (FIG. 2), passes a beacon, such as the beacon 20 on the floor 17. Each beacon 20 periodically emits an inquiry to determine if there is a card in the vicinity, and if there is, the card will respond with its identification number. In such a case, the result of test 27 is affirmative and a test 30 determines if the destination floor of the card bearing the current ID number (the ID number of passenger 29 in this example) has been designated as "fixed", meaning it can be changed only by the passenger, as described more fully hereinafter. If the destination for this ID number is designated as fixed, an affirmative result of test 30 will reach a step 31 to cause the card bearing that identification number to display the destination floor on the display 8 of the card 7, so that the passenger can see what floor is currently determined to be his next destination floor. On the other hand, if the destination floor for the passenger's ID has not been designated as fixed, which is the case when a passenger leaves an elevator (as described hereinafter), a negative result of test 30 will reach a step 32 to set a floor number equal to the floor of the beacon transponder which sensed the card's transmission, and a subroutine 33 to determine a likely next destination for this passenger based upon the floor number, the time and date and/or the passenger's floor-to-floor trip history. Passengers who have been using the elevator will have a history of destinations taken from one floor to another floor, so that when the passenger is sensed as being on the floor 17, a most likely next destination can be selected from history recorded about that passenger's travel habits. The time and day may be utilized to fine tune the decision of a likely next destination for such passenger. Or, there may simply be a table of next destinations related to current floors, thus avoiding use of histories and real time. Typically, if a passenger has entered on the lobby floor and exited on an office floor, the destination determined in the subroutine 100 will be the lobby floor for the subsequent trip back down to the lobby. Conversely, upon concluding a trip to the lobby, the next destination is likely to be the office floor. After a next destination is determined in the subroutine 33, a step 34 causes that destination to be transmitted to the card bearing that ID number, and the step 31 will cause the card to display the destination to the passenger. Then other programming is reverted to through a return point 35

When the passenger 29 walks out of range of the beacon 20 on floor 17, in a subsequent pass through the routine of FIG. 3, test 27 will be negative since the passenger's card is no longer responding to the beacon due to distance. This causes a test 36 to determine if the passenger had previously transmitted a new destination number or not. If the destination provided by the routine 33 were incorrect, the passenger may correct it by transmitting from the card 7 utilizing any of the keys 9–11. If the passenger has entered a new destination, an affirmative result of test 36 reaches a step 37 to set the destination of this identification number as "fixed". Then the steps 34 and 31 will transmit the new destination to the card and cause it to be displayed for the passenger to see, and other programming is reached through the return point 35.

On the other hand, if a new destination has not been received for any ID, a negative result of test 36 reaches a test 39 to determine if a hallway transponder has detected a card ID number. If a hallway transponder, such as either transponder 21 in FIG. 2, detects a card ID, an affirmative result of test 39 will reach a test 40 to see if a trip latch has been set, indicating that the passenger has just now exited an elevator. If so, a step 41 resets the trip latch; if not, the passenger is approaching the elevator to make a trip, so a negative result of test 40 reaches a step 45 to enter a hall call on the floor on which the hallway beacon 21 has detected the card ID number. Then a step 37 designates the destination for this ID as "fixed", so that it cannot be changed prior to entering a car call, unless the passenger changes it as described hereinbefore. Then, the steps 34, 31 transmit the just-fixed destination to the corresponding card and cause the card to display it.

In any subsequent pass through the routine of FIG. 3, with respect to the particular passenger 44 who has just approached the elevators and is waiting for the elevator to arrive, test 27 will be affirmative, and test 30 will be affirmative, so step 31 will display the destination to ensure that it is suitable. Eventually, passenger 44 will enter an elevator and in some subsequent pass through the routine of FIG. 3, test 27 will be negative, test 36 will be negative, test 39 will be negative, and a test 49 will be affirmative, reaching a step 50 to enter a car call for the destination corresponding to the passenger with the current ID number, a step 51 to reset the status of the destination for that ID number to no longer be "fixed", and a step 52 to set the trip latch. At the end of the trip, upon leaving the elevator, that passenger will pass in front of a beacon 20 on the destination floor; in a subsequent pass through the routine of FIG. 3, an affirmative result of test 27 and a negative result of test 30 will reach the step 33 to determine a likely destination for that passenger. The most likely destination would be whichever floor the passenger just came from, in a typical case. In any event, the subroutine 33 will provide a likely destination which step 34 will cause to be transmitted back to the card having that ID number. And then the card will be caused to display the destination (although it would be unlikely that passenger 42 will be looking at it as the passenger leaves the elevator corridor area). But on the next approach to the elevators past a hallway transponder 20, the passenger will, as customary, check the display destination and either correct it or not as appropriate. If the passenger entered a new destination, test 36 and step 37 would cause that destination to be designated as fixed; otherwise, the destination determined by the subroutine 33 may remain unfixed until the passenger returns to the elevator corridor, subsequently, to make another trip, as is described hereinbefore.

When there is no activity at all, a pass through the routine of FIG. 3 would find negative results of tests 27, 36, 39 and 49, thereby passing through the routine without performing any function at all.

Figure 4:
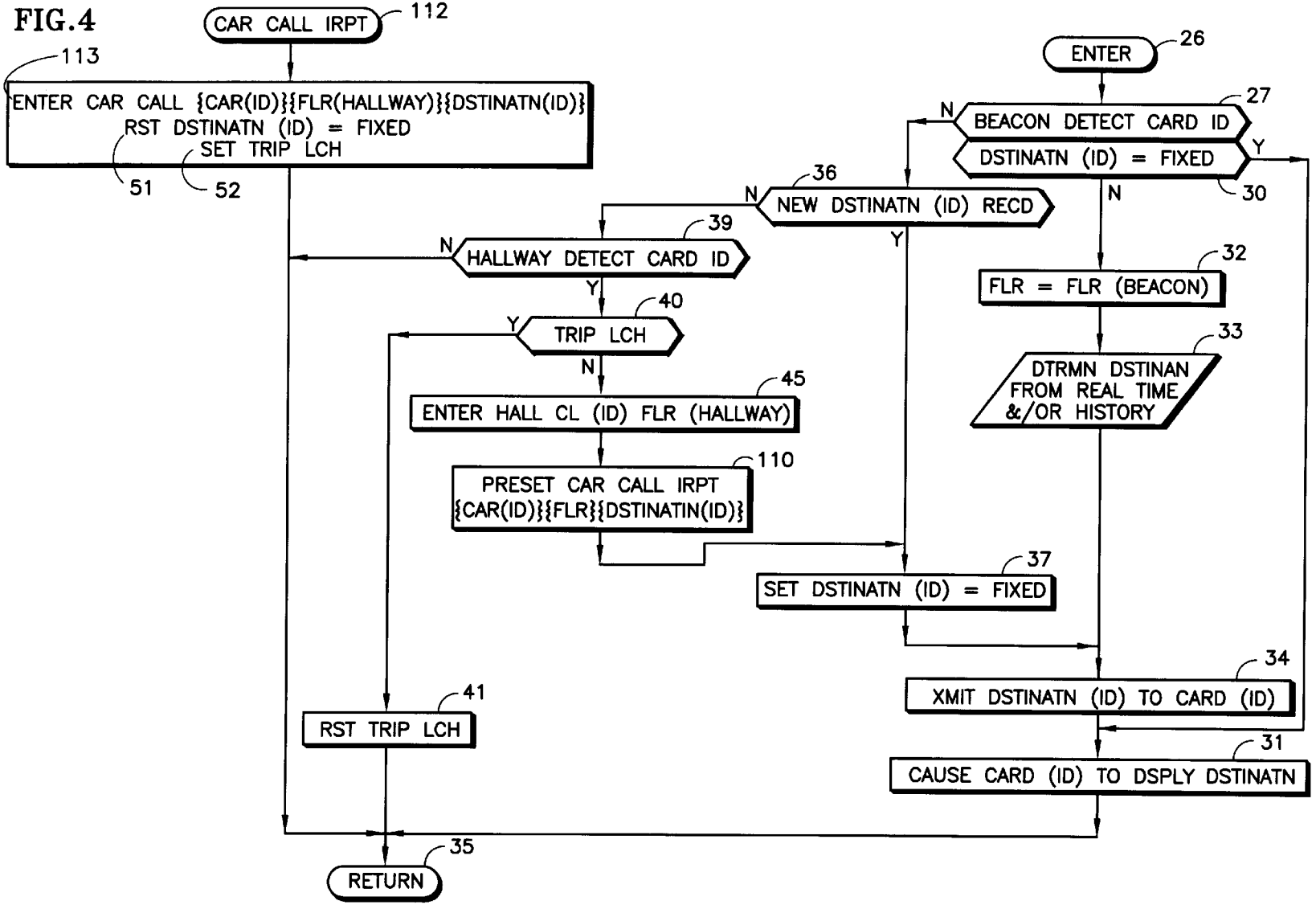
FIG. 4 is a high level functional flow chart, illustrating principles of an alternative centralized embodiment of the invention.

An embodiment of the invention which is suitable for use in elevator systems wherein there is no transponder in the elevator cars, is illustrated in FIG. 4. FIG. 4 is the same as FIG. 3 except for the fact that the car call is set by means of a step 111, which presets a car call interrupt for any car assigned to answer the hall call for the particular ID, when it reaches that particular floor, to enter a car call to the destination of that particular ID. When the responding car reaches the call floor, a car call interrupt enters the routine of FIG. 4 through an interrupt point 112, a step 113 enters the car call for the destination floor, the step 51 resets the status of the destination to no longer be "fixed", and the step 52 sets the trip latch. In any pass through the routine in which the results of tests 27, 36 and 39 are negative, all of the functions of FIG. 4 are bypassed. This embodiment might be useful in retrofit systems in which placement of transponders in the individual cars would be prohibitive.

In the centralized embodiments of FIGS. 3 and 4, the next destination may be stored on the card, being transmitted thereto by step 34, or being originated by pressing keys; pressing of any key (FIG. 1) may then display the destination. Thereafter, any key pressed may become part of the new destination, displayed key-by-key.

Figure 5:
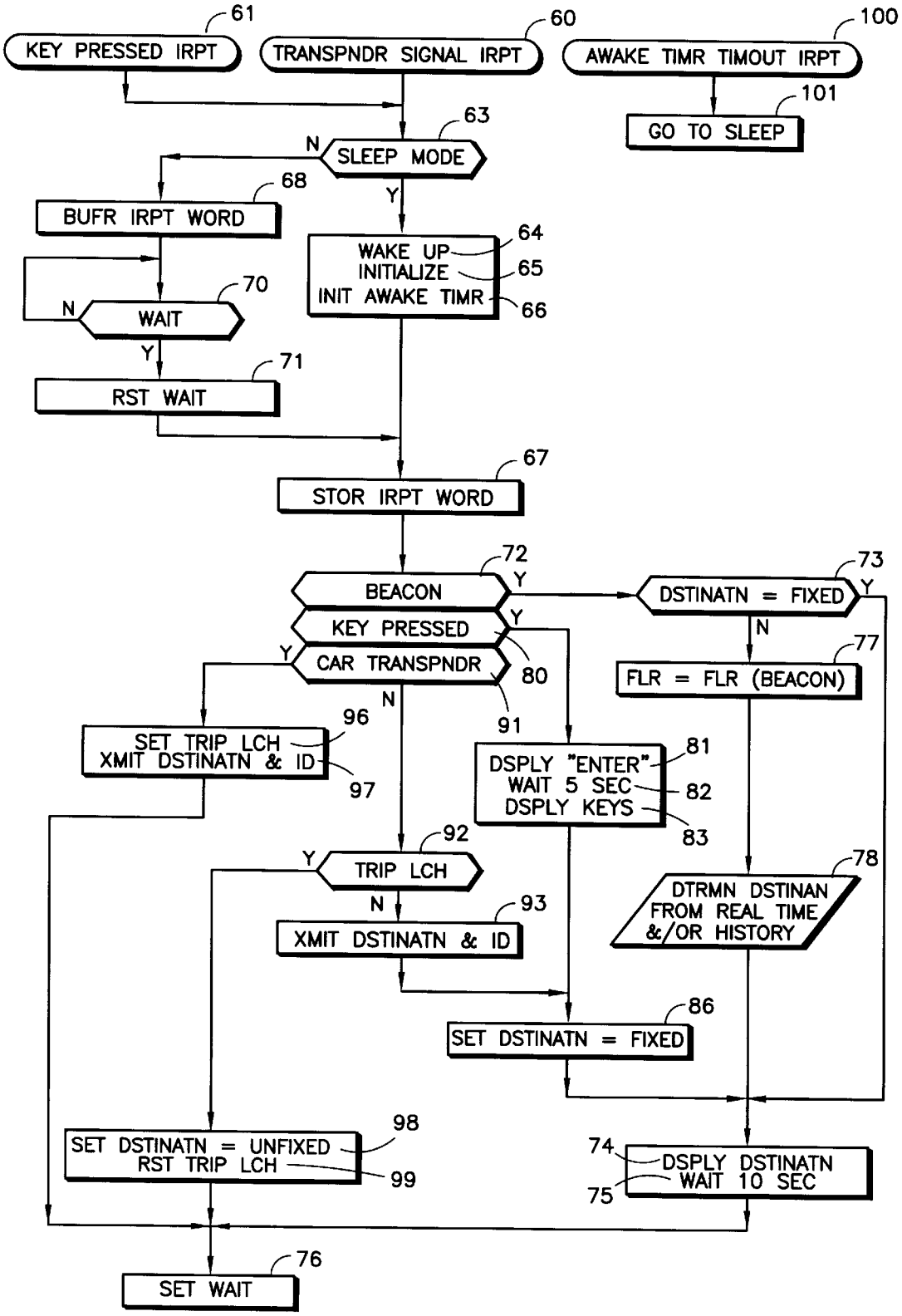
FIG. 5 is a high level functional flow chart, illustrating principles of a distributed embodiment of the invention.

A third embodiment of the invention is illustrated in FIG. 5. Therein, the high level functions of a routine for responding to beacons and updating and displaying destinations, wholly within the card, assumes use of a conventional microcomputer that has a sleep mode, and has no function when asleep except to respond to a received signal as an interrupt in order to wake up and become operational. In FIG. 5, the routine can be entered through either one of two interrupts; one is by reception of a transponder signal at an interrupt entry point 60 and the other is by sensing that a key has been pressed, through an interrupt entry point 61. The intentional pressing of a key by a human is of a sufficiently long duration (many milliseconds) so as to allow the computer time to wake up and recognize the nature of the interrupt. Similarly, transponder and beacon transmissions in the hallways and elevator corridor, can have messages with sufficient precursor bits so as to allow the computer to wake up and become operational in time to recognize the transponder or beacon designation or word and floor number at the end of the message. When an interrupt is received, a first test 63 determines if the computer is in a sleep mode. If it is, a series of steps, illustrated by steps 64–66 cause the computer to wake up, initialize and initiate an awake timer. Then a step 67 stores the interrupt word (that is, either the fact that a key pressed interrupt was received, or the name of the transponder or beacon which had caused the interrupt (beacon, hallway or car). On the other hand, if the computer is not in a sleep mode, a negative result of test 63 reaches a step 68 to buffer the interrupt word in a temporary storage, and a test 70 to determine if the computer is in a wait state (described hereinafter), or not. Until the computer is in a wait state, the present interrupt will not cause any response. Once the computer is in a wait state, the step 71 resets the wait state and the interrupt word is stored in the step 67. In this embodiment, the beacons 20 need only transmit, not receive, and may thus be transmitters instead of transponders; however, the term "transponder" herein includes transmitters.

A test 72 determines if the interrupt was caused by a beacon; if so, a test 73 determines if the status of the destination is "fixed". If it is, a step 74 causes the destination to be displayed and a step 75 causes the computer to wait ten seconds, to give a passenger time to think about looking at the destination as the passenger approaches an elevator. Then a step 76 places the computer into the wait state, referred to hereinbefore.

If the passenger has just left the elevator, the status of the destination is not "fixed", so a negative result of test 73 reaches a step 77 to set a floor number equal to the floor of the beacon, and a subroutine 78 determines a likely next destination from the floor number, real time, and/or the travel habit history of the passenger related to the particular ID, or from a list. Then the routine passes through the steps 74 and 75 and reaches the wait state in step 76.

The passenger may press some keys to try to enter a new destination. Initially, pressing keys will only cause the program to begin, through the step 64 or the step 68 as described hereinbefore. If such is the case, then test 72 will be negative but a test 80 will be positive reaching a plurality of steps 81–83, to cause the display 8 to display the word "enter" or the present next destination, then wait five seconds, and to thereafter cause the display 8 to display whatever activity there is then on the keys 9–11. Then a step 86 causes the status of the new destination established by the keys to be set to "fixed", the step 74 causes the destination to be displayed, and the step 75 causes the program to wait so that the passenger can view the destination that has been established, and change it again, if necessary. And the program proceeds as described hereinbefore to the wait state.

Assuming the passenger continues to walk away from the elevators, the device will receive a signal from a hallway transponder 21, causing the program to be started either through the step 64 or the step 68. In the usual case, the computer will still be awake when it reaches the hallways, having been awakened by the beacon. Tests 72, 80 and 91 will be negative, meaning, by default, that a hallway transponder caused the interrupt. This reaches a test 92 which determines if a trip latch has been set: this latch keeps track of the fact that the passenger is leaving the elevator, rather than entering the elevator to make a trip. As a passenger leaves the elevator, the trip latch will be set, so an affirmative result of test 92 reaches a step 98 which sets the destination status to "unfixed", and a step 99 which resets the trip latch.

Assume the passenger is walking toward an elevator, the hallway transponder is likely to be the first to receive a signal which will reach test 63 while the computer is asleep, thereby passing through steps 64–66. Negative results of test 72, 80, and 91 indicate a signal from the hallway transponder, by default. Negative results of test 72, 80, 91 and 92 will reach a step 93 to cause the destination and ID of the card to be transmitted, which will cause a hall call to be entered for this ID. Then the destination is designated as "fixed" in step 86, the destination is displayed at steps 74 and 75 and the program proceeds to the wait state as described hereinbefore. There may be several hallway transponder signals transmitted during the period of time that the passenger is walking toward the elevators. In such a case, each reception of the transponder signal will cause the program to advance through the steps and test 68–71, a negative result of tests 82, 80 and 92 to cause the destination and ID to be retransmitted at step 93. If during that period of time, the passenger decides to change the destination, a "key pressed" interrupt will occur; should this happen, it will simply buffer the interrupt word in step 68 and then determine whether the computer has reached the wait state or not. If not, the program will wait until the wait state is reached, and will thereafter process the "key pressed" interrupt, as described hereinbefore. Thereafter, the new destination will be transmitted at step 93.

When the card reacts to the beacon at the elevator, as the passenger waits for a car, an affirmative result of tests 72 and 73 cause the destination to be displayed in steps 74 and 75.

Eventually, a car will arrive and the passenger will enter the car in which case the card will receive a car transponder signal which will cause the program to proceed through negative results of tests 73 and 80 but an affirmative result of test 91, to reach a step 96 which sets the trip latch; this causes the program to recognize the fact that the passenger is in a car and will take a trip on the elevator for purposes described hereinbefore. Then a step 97 causes the destination and ID to be transmitted so that, upon receipt thereof by the car transponder, a destination car call is entered for the passenger. Then the program proceeds to the wait state as described hereinbefore.

When the trip is completed, the passenger will leave the elevator and will receive a beacon signal. This will cause the program to proceed through an affirmative result of test 72 and a negative result of test 73, once again, to determine a next destination as described hereinbefore.

Generally speaking, the awake timer may be set to on the order of one or two minutes to allow the computer to remain awake during the process of approaching, utilizing and leaving the elevator, so as to permit bypassing the steps 64–66, whereby to consume power. When the awake timer has timed out, an awake timer timeout interrupt will occur at point 100, causing the computer to go to sleep at point 101.

The manner in which the building responds to the activity taking place within the functions of FIG. 5 depends on the embodiment. In a building having transponders in the elevator cars, as described with respect to FIG. 3, test 91 and steps 96 and 97 will be functional as the passenger enters the car. In embodiments in which there are no car transponders, upon receipt of a destination and ID following step 93, the building would respond as illustrated by steps 45, 110 and 113, in FIG. 4, in an obvious fashion.

Even if a car call may only be entered for the passenger only after the car arrives, the destination of the passenger may be utilized by the dispatching controller to determine which car should answer the hall call, thereby to take destination into account in the hall call allocation scheme. As an alternative, the car calls could be entered immediately, and cancelled in the event that a passenger does not enter an elevator, in some embodiments, if desired.

The positions of the hallway (first) transponder and the beacon (second) transponder could be reversed. Instead of keys, the passenger may enter a new destination by voice as disclosed in commonly owned copending U.S. patent application Ser. No. 09/111,355, filed Jul. 7, 1998. In any case where a passenger may leave the elevator corridor without passing a hallway transponder, a trip latch timer, or other methodology, may be used to reset the trip latch.

A fourth embodiment may have the automatic next destination determined centrally by subroutine 33 of FIGS. 3 and 4, while having the fixed and unfixed status controlled in a distributed fashion by the steps 96 and 98 of FIG. 5.

All of the aforementioned patent applications and patents are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. In a system having at least one elevator serving a plurality of floors of a building, said system including cards carried by passengers, said cards having means for entering destination floor numbers and displays for displaying destination floor numbers, and in which an elevator control system communicates with the cards by means of electromagnetic messages, including messages bearing a unique passenger identification number (ID), the method of determining passenger destination floors comprising:

(a) keeping a record of destination floors for each passenger;

(b) in response to a passenger entering in one of said cards the floor number of a new destination, designating said destination as "fixed";

(c) in response to communication between said card and one of a plurality of first transponders located a first distance from the access to an elevator, entering a hall call;

(d) when a car arrives in response to said hall call, entering a car call for said destination and designating said destination as "unfixed"; and (e) in response to communication between said card and one of a plurality of second transponders located a second distance from the access to an elevator alternatively if said destination is designated as "fixed", causing said card to display said destination, or if said destination is designated as "unfixed", determining, from said record and the floor of said second transponder, a next-trip destination floor for said passenger.

2. A method according to claim 1 wherein:

all of said destinations are determined by a controller in said building.

3. A method according to claim 1 wherein:

all of said destinations are determined and designated by a controller in said building.

4. A method according to claim 1 wherein:

each of said destinations is designated by the corresponding card.

5. A method according to claim 1 wherein:

each of said destinations is determined and designated by the corresponding card.

6. A method according to claim 1 wherein said step (d) comprises:

in response to communication between said card and a transponder in said elevator car, entering said car call for said destination floor.

7. A method according to claim 1 wherein said steps (c) and (d) comprise:

in response to communication between said card and said first transponder, entering a hall call, designating said destination as fixed, and when a car arrives, entering a car call for said destination.

8. A method according to claim 1 wherein said first transponders are located remotely of the access to said elevator and said second transponders are located adjacent to said access.

9. A method according to claim 1 wherein said means for entering comprise keys.

10. A method for processing automatic elevator calls, comprising:

(a) providing one or more first transponders a first distance from an entrance of one or more elevators in a corridor on each floor of a building served by said one or more elevators;

(b) providing one or more second transponders a second distance from said entrance on each of said floors;

(c) providing a plurality of cards, each to be borne by a corresponding passenger, each card assigned an identification number (ID), each card having a display for displaying a floor number of a destination floor, each card having means for entering the floor number of a designation floor, each card responsive to a certain message from one of said transponders to display a destination floor for the bearer of the card, each card responsive to receipt of an electromagnetic message from at least one of said transponders to transmit an electromagnetic response message containing at least its ID;

(d) in response to receipt, by one of said cards, of an electromagnetic transmission from one of said first transponders, transmitting from said card an electromagnetic response message containing at least an identification number (ID) portion;

(e) in response to receipt by one of said first transponders of said response message, entering a hall call for said ID;

(f) entering a car call for said destination when a car arrives in response to said hall call and then designating said destination as "unfixed", (g) in response to a message transmitted between said card and one of said second transponders, either if said destination is designated as "fixed", causing said display to display the floor number of said destination, or if said destination is designated as "unfixed", determining from a record of destinations for said ID and the floor number of said one second transponder a currently proposed destination for said passenger; and (h) in response to a passenger entering a destination floor number using said data entry means, causing said floor number to be displayed on said display and designating said destination as "fixed".

11. A method according to claim 10 wherein:

all of said destinations are determined by a controller in said building.

12. A method according to claim 10 wherein:

all of said destinations are determined and designated by a controller in said building.

13. A method according to claim 10 wherein:

each of said destinations is designated by the corresponding card.

14. A method according to claim 10 wherein:

each of said destinations is determined and designated by the corresponding card.

15. A method according to claim 10 wherein said step (f) comprises:

in response to communication between said card and a transponder in said elevator car, entering said car call for said destination floor.

16. A method according to claim 10 wherein said steps (e) and (f) comprise:

in response to communication between said card and said first transponder, entering a hall call, designating said destination as fixed, and when a car arrives, entering a car call for said destination.

17. A method according to claim 10 wherein said first transponders are located remotely of the access to said elevator and said second transponders are located adjacent to said access.

18. A method according to claim 10 wherein said means for entering comprise keys.

19. Elevator call control apparatus for an elevator system having at least one elevator including a car for providing service between a plurality of floors of a building, said elevator system including a dispatching controller for registering calls for service and causing elevator response thereto, said apparatus comprising:

a plurality of first transponders, one disposed a first distance from an entrance to said at least one elevator on each of said floors, for transmitting an electromagnetic inquiry message and for receiving a response message, each of said first transponders interconnected with said dispatching controller, a plurality of second transponders, one disposed on each of said floors a second distance from the corresponding one of said entrances, each for sending an electromagnetic message;

a plurality of cards, each to be borne by a corresponding passenger, each card assigned an identification number (ID), each card having a display for displaying a floor number of a destination floor, each card having floor entry means for the passenger to input the floor number of a designation floor, each card responsive to receipt of an electromagnetic message from one of said transponders to transmit an electromagnetic message containing at least its ID;

signal processing means responsive to receipt by one of said first transponders of an electromagnetic message from one of said cards to register a hall call for the corresponding floor; for storing a destination record for each ID; for designating as "fixed" a destination input into one of said cards by a corresponding one of said floor entry means; for registering a car call to said destination when a car arrives in response to said hall call and for then designating said destination as "unfixed"; and responsive to one of said cards communicating with one of said second transponders, if said destination is designated "fixed", for causing said card to display said destination, but if said destination is designated as "unfixed", for determining a proposed destination floor for the next trip of each bearer in dependence on the floor of said one beacon and the corresponding one of said records.

20. Apparatus according to claim 19, wherein said signal processing means is disposed in said building and controls the destinations and designations for all of said cards.

21. Apparatus according to claim 19 wherein said signal processing means comprises:

first signal processing means disposed in said building for registering said hall call and said car call; and a plurality of second signal processing means, each disposed in one of said cards, each for providing said history, causing said display, determining said destination, and designating said destination as "fixed" or "unfixed" for the corresponding ID.

22. Apparatus according to claim 19 wherein said signal processing means comprises:

first signal processing means disposed in said building for registering said hall call and said car call, for providing said history, and for determining said destination; and a plurality of second signal processing means, each disposed in one of said cards, each for causing said display and for designating said destination as "fixed" or "unfixed" for the corresponding ID.

23. Apparatus according to claim 19 further comprising:

a car transponder disposed in each of said cars; and said signal processing means comprises means responsive to communication between said car transponder and said card for registering said car call and for then designating said destination as "unfixed".

24. Apparatus according to claim 19 wherein said first transponders are disposed remotely of said entrances and said second transponders are disposed adjacent to said entrances.

25. Apparatus according to claim 19 wherein said floor entry means comprises keys.

26. Apparatus according to claim 19 wherein said data processing means prepares said record by storing, for several days, the origin and destination floors of trips made by the bearer of each of said cards to provide a unique and independent, continuously updated history of related origin and destination floors for each bearer.

* * * * *